US006047684A

United States Patent [19]

Hiraku et al.

[11] Patent Number: 6,047,684

[45] Date of Patent: Apr. 11, 2000

[54] GEAR PUMP AND FUEL TRANSFER SYSTEM USING THE GEAR PUMP

[76] Inventors: Kenji Hiraku, 3-15-29, Inayoshi, Chiyoda-machi, Niihari-gun, Ibaraki 315-0054; Yuzo Kadomukai, 21-1, Minamidai 2-chome, Ishioka-shi, Ibaraki 315-0035; Yukio Takahashi, 2053-7, Takaba, Hitachinaka-shi, Ibaraki 312-0062; Kenji Okuna, Sharuman Copo Shinseto Hiruzu 604, 51, Naeba-cho, Seto-shi, Aichi 489-0983; Yasuo Kita, 3-5-9, Oeda Kitakutsukake-cho, Nishikyo-ku, Kyoto-shi, Kyoto 610-1101, all of Japan

[21] Appl. No.: 09/036,999

[22] Filed: Mar. 9, 1998

[30] Foreign Application Priority Data

Mar. 12, 1997 [JP] Japan ..... 9-057362

[51] Int. Cl.[7] ..... F02M 37/04

[52] U.S. Cl. ..... 123/497; 418/132

[58] Field of Search ..... 123/497, 458; 418/132, 135, 206.6

[56] References Cited

U.S. PATENT DOCUMENTS

| | | | |
|---|---|---|---|
| 3,890,068 | 6/1975 | Davidson | 418/132 |
| 3,961,872 | 6/1976 | Muller | 418/132 |
| 4,090,820 | 5/1978 | Teruyama | 418/132 |
| 4,205,648 | 6/1980 | Graham | 123/497 |
| 4,239,468 | 12/1980 | Smith | 418/132 |
| 4,392,798 | 7/1983 | Bowden | 418/132 |
| 4,518,331 | 5/1985 | Wood | 418/132 |
| 4,527,966 | 7/1985 | Laumont | 418/132 |
| 4,606,713 | 8/1986 | Lipscombe | 418/132 |
| 5,485,820 | 1/1996 | Iwaszkiewicz | 123/458 |

FOREIGN PATENT DOCUMENTS

| | | |
|---|---|---|
| 45-16300 | 6/1970 | Japan . |
| 2-294578 | 12/1990 | Japan . |
| 3-271577 | 12/1991 | Japan . |
| 4-231688 | 8/1992 | Japan . |

*Primary Examiner*—Carl S. Miller

*Attorney, Agent, or Firm*—Antonelli, Terry, Stout & Kraus, LLP

[57] ABSTRACT

A gear pump has a pair of gears a seal member for sealing up teeth of the gross engaging with each other in a sealed-up gear case, which seal member is provided at a place occupied by plurality of teeth in the vicinity of a working area of the teeth in a low pressure side of the gear case and is not connected to the gear case, the seal member having a low pressure fuel the flow of hole for flowing a low pressure fuel, wherein a tooth sealing angle for the plurality of teeth is set substantially to a value within a range of 35°±5° for gears having of 14 to 18 teeth, and a high pressure fuel flowing passage for the flow of a high pressure fuel, formed in a space other than the working area of the teeth and the area of and the sealing member, in the gear case. Further, a fuel system for vehicle engine, using the above-mentioned gear pump, includes a fuel tank, a first pipe connecting the fuel tank and the low pressure fuel flowing hole in the gear pump, a second pipe connecting a fuel injection nozzle and the high pressure fuel flowing passage in the gear pump, and a booster pump provided at an intermediate part of the first pipe, for raising the pressure of fuel transferred to the low pressure fuel flowing hole to a pressure value at which the occurrence of cavitation at the low pressure fuel flowing hole can be suppressed.

15 Claims, 5 Drawing Sheets

CASE OF TOOTH SEALING ANGLE CORRESPONDING TO ONE TOOTH

CASE OF TOOTH SEALING ANGLE CORRESPONDING TO ONE AND HALF TEETH

CASE OF TOOTH SEALING ANGLE CORRESPONDING TO TWO TEETH

GEAR PUMP AND FUEL TRANSFER SYSTEM USING THE GEAR PUMP

BACKGROUND OF THE INVENTION

The present invention relates to a gear pump and a fuel transfer system using the gear pump, especially to a gear pump which is effective for use in a fuel system of a vehicle engine.

A gear pump used for an internal combustion engine and an automatic transmission gear, and a fuel transfer apparatus including a gear pump, are disclosed in JP-A-271577/1991 and JP-A-294578/1990, respectively.

Further, JP-A-231688/1992 discloses a gerotor pump comprising inner and outer gear rotors for forming a pump space between teeth engaging with each other, the volume of which changes with the expanding and narrowing in a circumferential part, a fluid inlet and a fluid outlet, which are isolated from each other, communicating with the pump space and opening in their axial directions; an apparatus connected to the inner gear rotor, for driving the inner gear rotor so as to transfer fluid from the inlet to the outlet; an apparatus including a housing containing the inner and outer gear rotors, for guiding rotation of the inner gear rotor; and a bearing apparatus provided adjacent to the outlet of the housing, for bearing the outer gear rotor, wherein the outer gear rotor can freely move besides being born by the bearing apparatus, and a fluid leaking gap in an expanded pump space is reduced by the outer gear rotor, which is pressed to the bearing apparatus by the pressure of fluid in a narrowed pump space.

Further, Japanese Patent Publication 16300/1970 discloses an oil pressure gear pump or motor in which a sealing member for sealing tooth parts of teeth engaging with each other in a sealed-up gear case is provided at a part neighboring a gear working place at a low pressure side of the pump, set separately from the gear case, and oil passing holes are formed in the sealing member.

By separating the fuel pump from the engine, the possibility of increasing the amount of fuel to be injected at the time of engine starting is improved, and any restriction on the location of the pump is removed, which improves the freedom of design, and so a motor driven gear pump provided in a vehicle separately from the engine has been devised. However, it has been required that the operational efficiency or the reduction in fuel consumption of a conventional gear pump is to be improved.

The gear pump disclosed in Japanese Patent Publication 16300/1970 has a feature that its structure is simple, and it has a high efficiency and good reliability when using a fluid of high viscosity. However, as mentioned in the publication, since the disclosed gear pump is used as an oil pressure gear pump, the pump is not suitable for use as a fuel pump for a vehicle in which a low viscosity fuel is used. In a fuel pump of a vehicle, used mainly for transferring gasoline, the occurrence of cavitation should be prevented. Moreover, since a fuel pump is used in a fuel system of a vehicle, the pump is required to have an excellent pressure rising performance and to make it possible to attain a low fuel consumption.

SUMMARY OF THE INVENTION

An object of the present invention is to provide a gear pump, applicable for use as a low viscosity fuel pump, and to a fuel system using the pump, while taking full advantage of the benefits of a seal type gear pump, and, especially, to provide a fuel system in a direct injection type engine by using the gear pump according to the present invention.

Another object is to provide a gear pump capable of attaining the above-mentioned object, while having the following further features, that is, (a) the ability to prevent occurrence of cavitation when used as a fuel pump in a gasoline engine of a vehicle, and (b) having an excellent pressure rising performance and a low fuel consumption, and to provide a fuel system of a vehicle using the gear pump.

When a seal block type gear pump having the highest efficiency among various types of gear pumps, and which is a well-known oil pressure pump, is used to transfer a low viscosity fluid, for example, gasoline, the following problems need to be solved.

(1) To prevent cavitation in the suction of the fuel:

Since the cross-sectional area of the suction port is small in a seal block type gear pump, cavitation tends to occur easily, especially in the pumping of gasoline.

(2) To improve the volumetric efficiency (suppress fuel leakage):

Since gasoline has a low viscosity (1/100 of that of oil), the leakage from low compression space of a pump is large in a gear pump.

(3) To improve the mechanical efficiency (reduce friction among parts in a pump):

It is necessary to reduce friction among parts in the pump under the condition that use of a lubricating material is not permitted.

(4) To extend the life of the pump (reduce wear on parts in the pump and prevent the occurrence of cavitation damage):

Since gasoline is not lubricative, cavitation damage tends to occur easily in the pumping of gasoline.

In order to attain the above-mentioned objects, the present invention provides a fuel system for a vehicle engine in which fuel is injected and combusted by a spark ignition, the fuel system comprising: a fuel injection nozzle for injecting fuel; a gear pump including a seal member for sealing up teeth engaging with each other in a sealed-up gear case, which seal member is provided at a place occupied by at most two teeth in the vicinity of the working area of the teeth on a low pressure side, not connected to the gear case, the seal member having a low pressure fuel flowing hole for the flow of a low pressure fuel, wherein the tooth sealing angle for the at most two teeth is set substantially to a value within a range of 35°±5° for gears having 14 to 18 teeth, and a high pressure fuel flowing passage for the flow of a high pressure fuel, formed in a space other than the working area of the gear teeth and the seal member, in the gear case; a fuel tank; a pipe connecting the fuel tank and the low pressure fuel flowing hole; and a pipe connecting the fuel injection nozzle and the high pressure fuel flowing passage.

The present invention further provides a fuel system for a vehicle engine in which fuel is injected and combusted by a spark ignition, the fuel system comprising: a fuel injection nozzle for injecting fuel; a gear pump including a seal member for sealing up teeth engaging with each other in a sealed-up gear case, which seal member is provided at a place occupied by at most two teeth in the vicinity of the working area of the teeth on a low pressure side, not connected to the gear case, the seal member having a low pressure fuel flowing hole for the flow of a low pressure fuel, and a high pressure fuel flowing passage for the flow of a high pressure fuel, formed in a space other than the working area of the gear teeth and the sealing member in the gear case, wherein the pressure in the high pressure fuel flowing passage is increased within a range of 3 to 10 MPa; a fuel tank; a pipe connecting the fuel tank and the low pressure fuel flowing hole; and a pipe connecting the fuel injection nozzle and the high pressure fuel flowing passage.

The present invention further provides a fuel system for a vehicle engine in which fuel is injected and combusted by a spark ignition, the fuel system comprising: a fuel injection nozzle for injecting fuel; a gear pump including a seal member for sealing up teeth engaging with each other in a sealed-up gear case, which seal member is provided at a place occupied by at most two teeth in the vicinity of the working area of the teeth on a low pressure side, not connected to the gear case, the sealing member having a low pressure fuel flowing hole for the flow of a low pressure fuel, wherein the tooth sealing angle for the at most two teeth is set substantially to a value within a range of 35°±5° for gears having 4 to 18 teeth, and a high pressure fuel flowing passage for the flow of a high pressure fuel, formed in a space other than the working area of the gear teeth and the sealing member, in the gear case, wherein the pressure in the high pressure fuel flowing passage is increased to a value within a range of 3 to 10 MPa; a fuel tank; a pipe connecting the fuel tank and the low pressure fuel flowing hole; and a pipe connecting the fuel injection nozzle and the high pressure fuel flowing passage.

The present invention further provides a fuel system for a vehicle engine in which fuel is injected and combusted by a spark ignition, the fuel system comprising: a fuel injection nozzle for injecting fuel; a gear pump including a seal member for sealing up teeth engaging with each other in a sealed-up gear case, which seal member is provided at a place occupied by at most two teeth in the vicinity of the working area of the teeth on a low pressure side, not connected to the gear case, the sealing member having a low pressure fuel flowing hole for the flow of a low pressure fuel, and a high pressure fuel flowing passage for the flow of a high pressure fuel, formed in a space other than the working area of the gear teeth and the sealing member, in the gear case; a fuel tank; a first pipe connecting the fuel tank and the low pressure fuel flowing hole; a second pipe connecting the fuel injection nozzle and the high pressure fuel flowing passage; and a booster pump provided at an intermediate part of the first pipe, for raising the pressure of fuel transferred to the low pressure fuel flowing hole to a pressure value at which the occurrence of cavitation at the low pressure fuel flowing hole can be suppressed.

Moreover, in the above-mentioned fuel system, it is preferable to set the discharge pressure of the booster pump to a value within a range of 0.2 to 0.5 MPa.

Furthermore, in order to attain the objects of the invention, the present invention provides a gear pump used to transfer fuel in a vehicle, the gear pump comprising: a seal member for sealing up teeth engaging with each other in a sealed-up gear case, which is provided at a place occupied by a plurality of teeth in the vicinity of the working area of the teeth on a low pressure side, not connected to the gear case, the sealing member having a low pressure fuel flowing hole for the flow of a low pressure fuel; and a high pressure fuel flowing passage for the flow a high pressure fuel, formed in a space other than the working area of the gear teeth and the sealing member, in the gear case; and side plates provided at both sides of the gears of the pump, wherein the heat expansion coefficient of material forming the gears is equal to that of the material forming the side plates.

The present invention further provides a gear pump used to transfer fuel in a vehicle, the gear pump comprising: a seal member for sealing up teeth engaging with each other in a sealed-up gear case, which is provided at a place occupied by a plurality of teeth in the vicinity of the working area of the teeth on a low pressure side, not connected to the gear case, the sealing member having a low pressure fuel flowing hole for the flow of a low pressure fuel, wherein the tooth sealing angle for the plurality of teeth is set substantially to an angle θ obtained by an equation expressed as "$\theta=1.5\times(360°/\text{the tooth number } Z \text{ of a gear})$, where Z is the number of 14 to 18"; and a high pressure fuel flowing passage for the flow of a high pressure fuel, formed in a space other than the working area of the gear teeth and the sealing member, in the gear case.

Moreover, in the above-mentioned gear pump, it is preferable to set the tooth sealing angle to a value within a range of the angle θ obtained by the equation ±5°.

The present invention further provides a gear pump comprising: a seal member for sealing up teeth engaging with each other in a sealed-up gear case, which is provided at a place occupied by a plurality of teeth in the vicinity of the working area of the teeth on a low pressure side, not connected to the gear case, the sealing member having a low pressure fuel flowing hole for the flow of a low pressure fuel, wherein the tooth sealing angle for the plurality of teeth is set substantially to a value within a range of 35°±5° for gears having 14 to 18 teeth; and a high pressure fuel flowing passage for the flow of a high pressure fuel, formed in a space other than the working area of the gear teeth and the sealing member, in the gear case.

The present invention further provides a gear pump used to pump fuel in a vehicle, the gear pump comprising: a seal member for sealing up teeth engaging with each other in a sealed-up gear case, which seal member is provided at a place occupied by a plurality of teeth in the vicinity of the working area of the teeth on a low pressure side, not connected to the gear case, the sealing member having a low pressure fuel flowing hole for the flow of a low pressure fuel; a high pressure fuel flowing passage for the flow of a high pressure fuel, formed in a space other than the working area of the gear teeth and the sealing member, in the gear case; and a pressure partition seal located in each of side plates provided at both sides of the gears of the pump, wherein each pressure partition seal has the shape of a closed curve.

The present invention further provides a gear pump used to pump fuel in a vehicle, the gear pump comprising: a seal member for sealing up teeth engaging with each other in a sealed-up gear case, which seal member is provided at a place occupied by at a plurality of teeth in the vicinity of the working area of the teeth on a low pressure side, not connected to the gear case, the sealing member having a low pressure fuel flowing hole for the flow of a low pressure fuel; a high pressure fuel flowing passage for the flow of a high pressure fuel, formed in a space other than the working area of the gear teeth and the sealing member, in the gear case; and a pressure partition seal located in each of side plates provided at both sides of gears of the pump, wherein the cross section of each pressure partition seal is in the shape of steps.

The present invention further provides a gear pump comprising: a seal member for sealing up teeth engaging with each other in a sealed-up gear case, which seal member is provided at a place occupied by a plurality of teeth in the vicinity of the working area of the teeth on a low pressure side, not connected to the gear case, the sealing member having a low pressure fuel flowing hole for the flow of a low pressure fuel and a high pressure fuel flowing passage for the flow of a high pressure fuel, formed in a space other than the working area of the gear teeth and the sealing member, in the gear case, wherein the shaft of the driven gear of the two gears in the pump is arranged so as to be not retrained by the gear ease, and the internal arrangement of the pump is such that a reaction force due to rotation of the two gears, applied to the internal parts as a whole, including the two gears and the sealing member, is opposed at a middle position in the back face of the sealing member.

The present invention further provides a gear pump comprising: a seal member for sealing up teeth engaging with each other in a sealed-up gear case, which seal member is provided at a place occupied by a plurality of teeth in the vicinity of a working area of the teeth on a low pressure side, not connected to the gear case, the sealing member having a low pressure fuel flowing hole for the flow of a low pressure fuel; and a high pressure fuel flowing passage for the flow of a high pressure fuel, formed in a space other than the working area of the gear teeth and the sealing member, in the gear case, wherein the length of a circular arch part of the sealing member is larger than that of each circular arch part of two sealing portions of each side plate.

DETAILED DESCRIPTION OF THE EMBODIMENTS

For a fuel system of a direct injection type engine, a piston pump has been used heretofore. Although a piston pump has a high operational performance, a piston pump has a problem in that the number of parts which make up the piston pump is large, so that a high working accuracy for the piston pump is required, which increases the production cost. On the other hand, since a gear pump is made up of a fewer number of parts, the production cost thereof can be largely reduced. However, in a gear pump, a difficult problem in its operational performance remains, and so it has not been easy to apply a gear pump in practice to all uses. In the following, an embodiment of the present invention wherein a gear pump is applied to a fuel system, especially a gasoline fuel system, of a direct injection type engine, will be explained with reference to the drawings.

Figure 1:
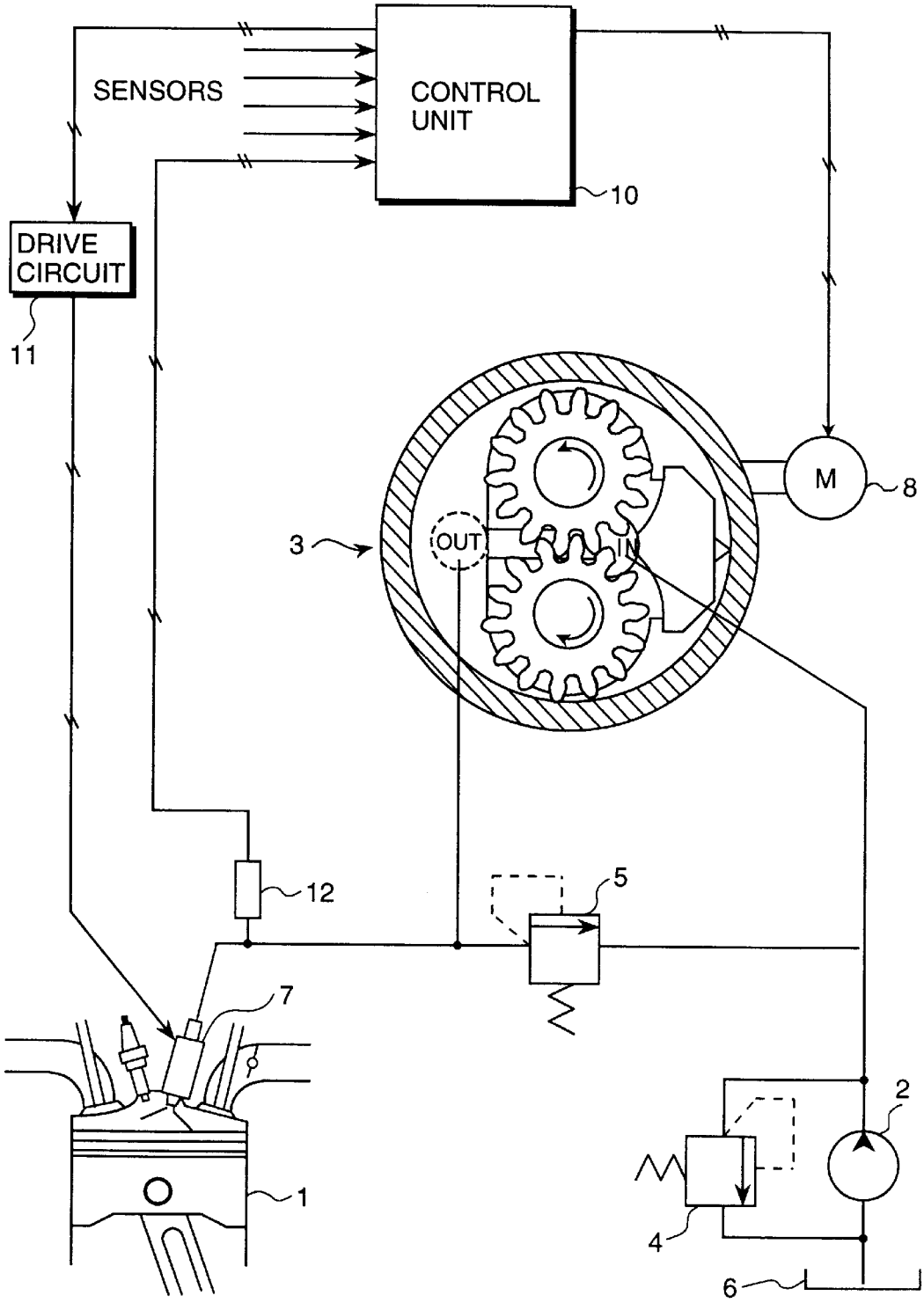
FIG. 1 is a schematic diagram showing a fuel system for a vehicle engine according to the present invention.

FIG. 1 is a schematic diagram showing the composition of a fuel system for use in a vehicle engine, according to the present invention. As shown in FIG. 1, the fuel system comprises a feed pump 2 for transferring fuel from a tank 6, a seal block type gear pump 3 (hereinafter simply referred to as a gear pump) for further increasing the pressure of fuel discharged from the feed pump 2, a motor 8 for driving one of two gears in the gear pump 3, a low pressure regulator 4 for adjusting the pressure of fuel discharged from the feed pump 2, a high pressure regulator 5 for adjusting the pressure of fuel discharged from the gear pump 3, an injection valve 7 for injecting fuel received from the gear pump 3 directly into an engine cylinder, a drive circuit 11 for sending an electrical drive signal to each of a plurality of injection valves 7, a pressure sensor 12 for detecting the pressure of fuel to be fed to the injection valves 7, and a control unit 10 for sending input signals to the drive circuit 11 and the motor 8, based on information sent from various sensors.

Although the pressure of fuel discharged from the gear pump 3 is regulated by the high pressure regulator 5, it is also possible to regulate the pressure by using a fixed restrictor in place of the regulator 5 and controlling the rotation speed of the gear pump 3. That is, the control unit 10 can regulate the pressure of the discharged fuel by controlling the rotation speed of the motor 8, based on information sent from the pressure sensor 12. By using this pressure regulating method, it is possible to omit the high pressure regulator 5 and to realize a variable pressure control for adjusting fuel discharged from the gear pump 3 to an arbitrarily set value.

The fuel system used for a vehicle engine according to the present invention is applied, for example, to a direct injection type engine. In a direct injection type engine, since it is necessary to inject fuel directly into a high pressure cylinder during a compression stroke with a preset amount of fuel for a short injection period, the pressure of fuel to be injected, namely, the discharge pressure of the gear pump 3, should be increased much more highly, for example, to 3–10 MPa, in comparison with that needed in a conventional port injection engine. Also, it is expected that the pressure of fuel injection will need to be further increased in the future.

Although a seal block type gear pump, which is adopted for the fuel system according to the present invention, has the highest efficiency among various types of gear pumps, it has also the disadvantage that its suction port is narrow, which is brought about by its particular structure. Consequently, the speed of the suction flow is high and cavitation tends to occur easily in this type of pump. That is, when the speed of fuel flow inside the gear pump 3 increases, the lowest pressure in the gear pump 3 decreases. Further, if the lowest pressure decreases to a value less than the air separation pressure, cavitation occurs in the gear pump 3. If cavitation occurs in the gear pump 3, the discharge flow rate will not increase any more despite any increase in the rotation speed. Moreover, gas bubbles generated in the suction port collapse at the discharge side and pressure pulses are generated. These pressure pulses cause a serious problem in that the metal surface inside the pump 3 is damaged, namely, by cavitation erosion.

Gasoline is a fluid which tends to cause cavitation easily, and gas bubbles begin to generate at about 40° C. and briskly generate at about 50° C. Since the temperature of gasoline in an engine is increased by the heat of the engine, cavitation tends to occur more easily. Therefore, it is difficult to simply apply an existing seal block type gear pump for the feeding of gasoline in the fuel system of a vehicle engine.

Accordingly, in the fuel system of a vehicle engine, according to the present invention, the feeding pump 2 used for pressure boosting is arranged at the upstream side of the seal block type gear pump 3, and the occurrence of cavitation is suppressed by setting the boosted pressure to about 0.2–0.5 MPa. By adopting these features in the fuel system, a seal block type gear pump becomes applicable to a fuel system of a vehicle engine. That is, since the saturated amount of air soluble in gasoline increases as the pressure of gasoline increases, the occurrence of cavitation can be suppressed by increasing the suction pressure of the seal block type gear pump 3 using the booster feed pump 2.

However, it is desirable to set the boosted pressure as low as possible within a range capable of suppressing cavitation, from the point of view of reducing the fuel consumption. Although the physical properties of gasoline are diverse, since gasoline itself is a mixture, a boosted pressure of 0.2–0.5 MPa is adequate to suppress the occurrence of cavitation, while allowing the driving force of the booster feed pump 2 to be set to a small force.

Although a seal block type gear pump becomes applicable to a fuel system for a vehicle engine by using the above fuel system and the above boost pressure control method, further improvement of the efficiency of a seal block type gear pump is required to reduce the fuel consumption. More particularly, since the viscosity of gasoline is lower by about 1/100 in comparison with that of ordinary oil of the type used for an oil pressure operation, the leakage of gasoline inside a pump is generally large, and the volumetric efficiency is remarkably decreased. Further, since the lubricity of gasoline is low, it is estimated that the mechanical efficiency of the pump when pumping gasoline is also low, which is caused by an increase in the friction resistance among parts inside the gear pump. Thus, it is difficult to maintain the reliability of the gear pump, with regard to wearing and seizing of parts inside the gear pump, when it is used to pump gasoline.

To solve the above-mentioned problems, the seal block type gear pump 3 according to the present invention has various novel features. Hereafter, details of the structure of the gear pump 3 will be explained with reference to FIG. 2–FIG. 6.

Figure 2:
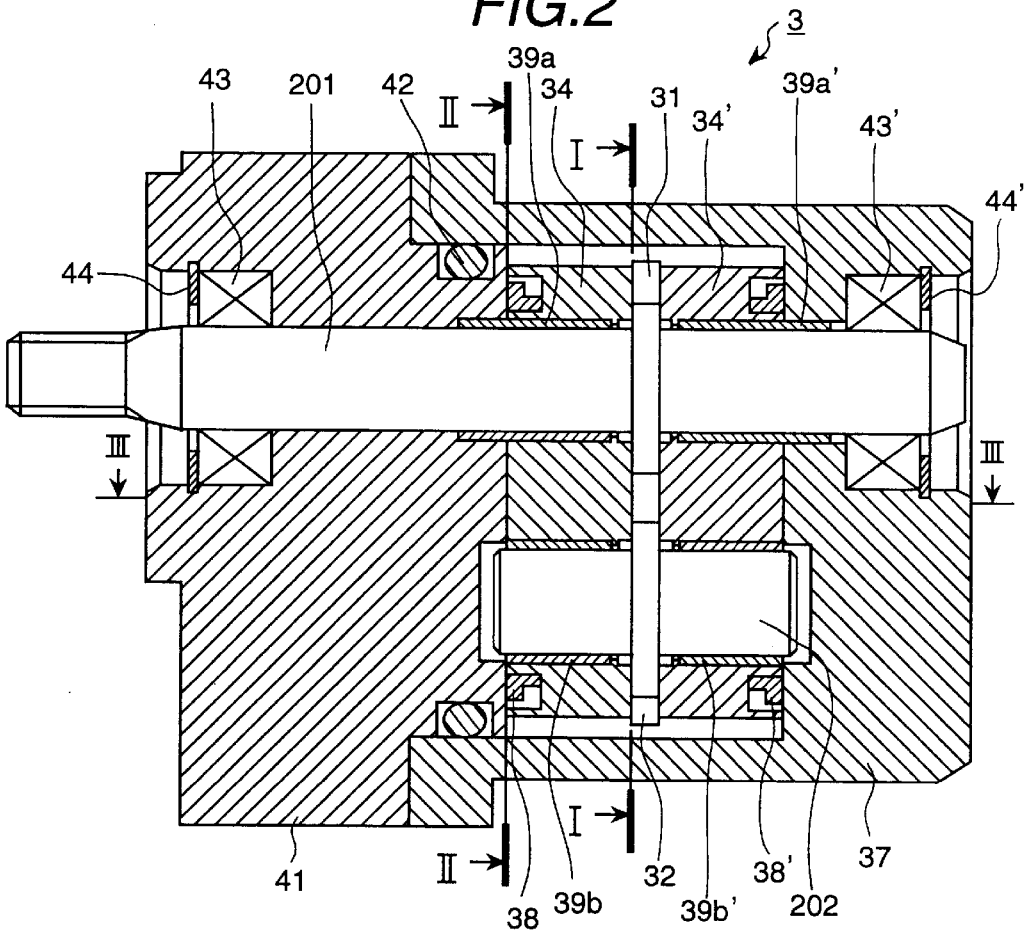
FIG. 2 is a vertical longitudinal cross section of a seal block type gear pump forming an embodiment according to the present invention.
Figure 3:
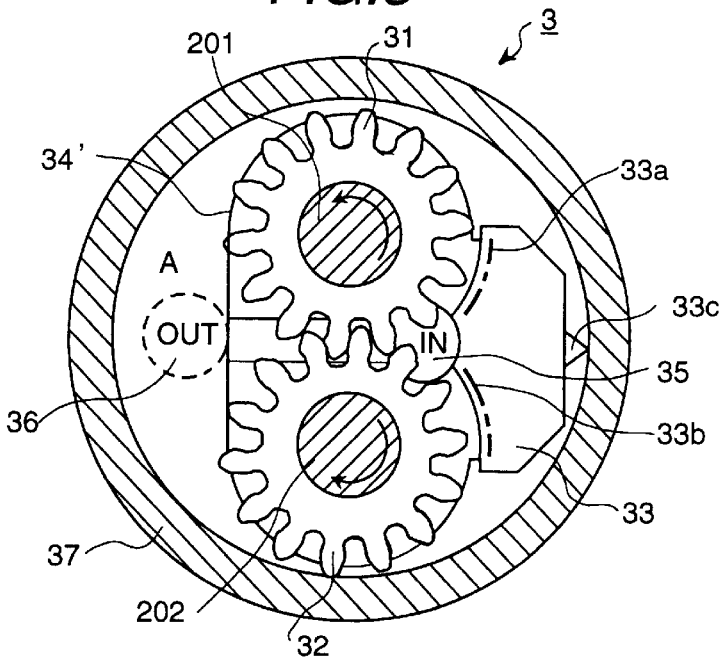
FIG. 3 is a vertical front cross section of the seal block type gear pump of as seen along line I—I in FIG. 2.
Figure 4:
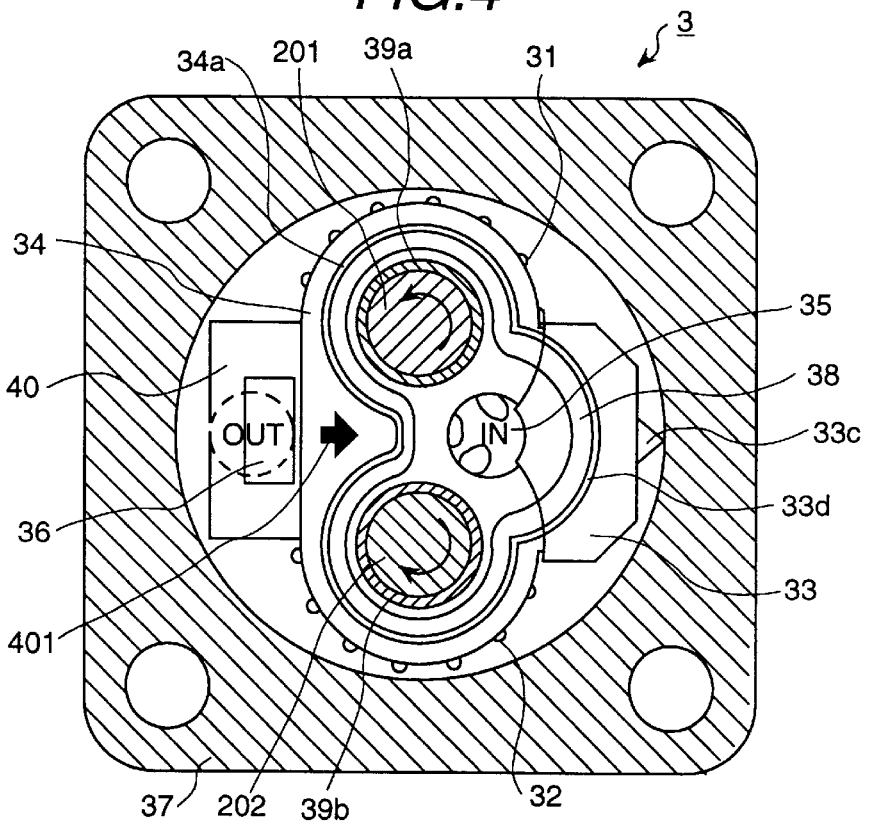
FIG. 4 is another vertical front cross section of the seal block type gear pump as seen along line II—II in FIG. 2.
Figure 5:
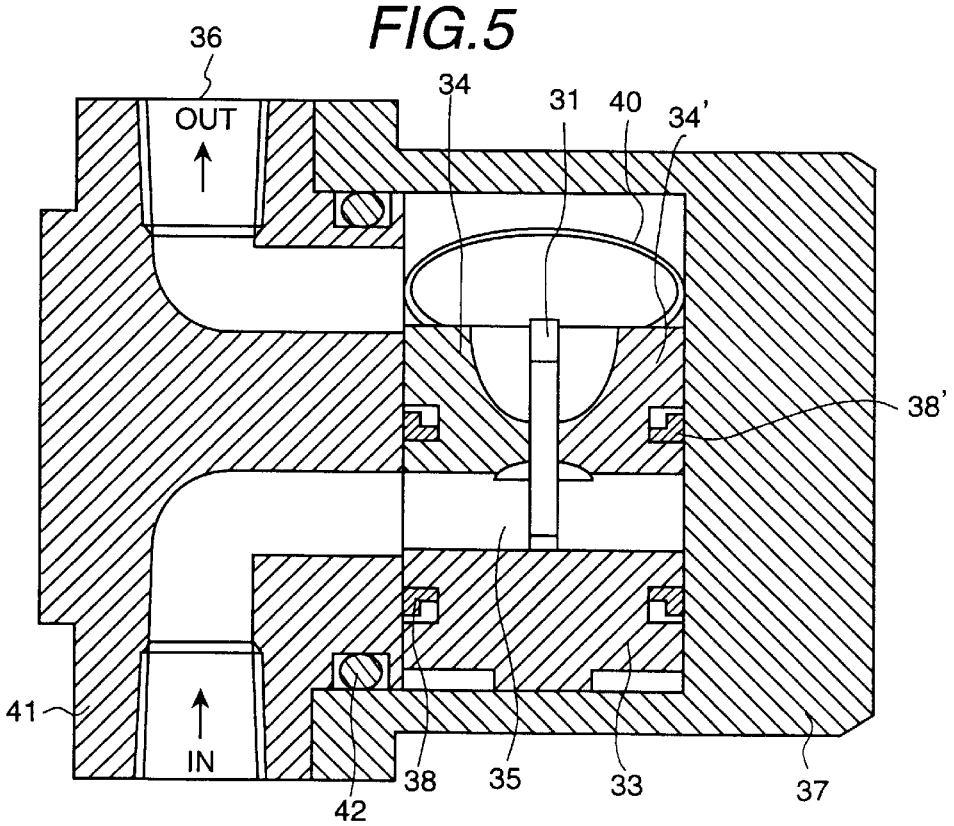
FIG. 5 is a horizontal longitudinal cross sectional view of the seal block type gear pump as seen along line III—III in FIG. 2.

FIG. 2 is a vertical longitudinal cross section of the seal block type gear pump 3 representing an embodiment according to the present invention, and vertical front cross-sectional views at respective sections I—I, II—II and III—III are shown in FIGS. 3–5, respectively.

In FIG. 2, numerals 41 and 37 indicate a front cover and a rear case, respectively, and a driving gear 31 integrated with a drive shaft 201 is supported by the front cover 41 and the rear case 37 via bearings 39*a* and 39*a*'. A driven gear 32 integrated with a shaft 202, which is rotatably supported, and the driving gear 31 engaging with the driven gear 32 rotates and pumps fuel. An inside surface of each of a pair of side plates 34 and 34' is in slideable contact with an outside surface of each of the gears 31 and 32. As shown in FIGS. 3 and 4, each of the side plates 34 and 34' has a pair of holes through which the shafts 201 and 202 pass, and respective pairs of bearings (39*a* and 39*a*') and (39*b* and 39*b*') are fitted to the pairs of holes to rotably support the shafts. Thus, the interval between the driving gear 31 and the driven gear 32 is held to a preset distance, and the two axes of the gears 31 and 32 are maintained in a parallel relationship to each other.

The space inside the rear case 37 is cylindrical, as shown in FIGS. 3 and 4, and the gears 31 and 32 are supported in the rear case 37 without contacting the inner wall of the rear case 37. Further, the side plates 34 and 34' are sandwiched and supported between the rear case 37 and the front cover 41. The side plates 34 and 34' have the same shape, and their inner faces for sealing the gears 31 and 32, as well as the other outside faces opposite to an inside surface of the front cover 41 or the rear case 37, are formed as shown in FIGS. 3 and 4, respectively.

Each of the side plates 34 and 34' has a suction port 35 serving as a fuel suction flow hole. Further, the radius of each circular arch part R at two portions neighboring the suction port 35, of each side plate, is formed almost equally to that of an addendum circle of each gear. Numeral 33 indicates a sealing member (hereafter, referred to as a seal block) for sealing a part of the crests in the teeth of each gear, which seal block is arranged separately from the front cover 41 and the rear case 37. The diameter of each of two arcuate sealing faces in the seal block 33 is formed to be equal to the outer diameter of each gear, that is, the circular arch part R at the two portions neighboring the suction port 35 in each side plate. Further, the seal block 33 is sandwiched and supported by the side plates 34 and 34', while the two sealing faces contact each circular arch part R of each side plate. The suction port 35 is formed in the side plates 34 and 34', the seal block 33 and the front cover 41, as seen in FIG. 5. Moreover, the discharge port 36 is formed in the front cover 41, and it communicates with the space inside the rear case 37.

One of features of a seal block type gear pump is that since the tooth front gap is determined by the size and geometric relation between the gear and the side plates, and since the accumulation of working tolerances of many of the parts which make up the gear pump does not affect the tooth front gap, deviation in the operational performance of the gear pump is small. Further, since the inner surface of the seal block is scraped by the gears during running-in operations, the working tolerances are removed and the tooth front gap becomes very narrow and smooth.

In the embodiment according to the present invention, a stable operational performance of the gear pump 3 is secured by producing the gears 31 and 32 of the gear pump 3 and the side plates 34 and 34' with materials having the same thermal expansion coefficient in the wide range of temperatures at which a pump for a vehicle is usually operated. If the thermal expansion coefficient of the material making up the gears 31 and 32 is different from that of the material of the side plates 34 and 34', since the interval between the addendum circle of each gear and each circular arch part R of each side plate possibly may increase due to charges in the operational temperature, the tooth front gap widens, which largely decreases the volumetric efficiency of the gear pump 3.

Gasoline sucked from the suction port 35 by pumping operations of the two gears 31 and 32 is discharged into the inside space A of the rear case 37. When the inside space A is filled with gasoline, gasoline is discharged from the discharge port 36 to the outside of the gear pump 3.

In FIG. 4, numerals 38 and 38' indicate pressure partition seals, the seal 38 (38') being inserted in grooves 34*a* and 33*d* formed at respective outside surfaces of the side plate 34 (34') and the seal block 33, for sealing a contacting face of the suction port 35. The pressure partition seals 38 and 38' are provided so that gasoline in the inside space A of the rear case does not communicate with the suction port 35 through each contacting face of the suction port 35 due to the pressure difference between the discharge pressure in the rear case 37 and the suction pressure at the suction port 35. Moreover, the pressure distribution at each back face (outside surface) in the side plates, which is in contact with the front cover or the rear case, is adjusted by the pressure partition seals 38 and 38' to balance the thrust force in the axial direction and the pressure at the inside between the side plates 34 and 34' (contacting faces between the gears and the side plates) so that a thrust force is not applied to the gears.

That is, by using the above-mentioned pressure partition seals 38 and 38', the inner pressure and outer pressure of each pressure partition seal are set to be equal to the suction pressure and the discharge pressure, respectively. Thus, the pressure at the inside faces of the side plates 34 and 34' becomes totally equal to the pressure at the outside faces of the side plates 34 and 34', and the pressure in the axial direction is completely balanced. Further, the sides of the gears and the faces of the side plates 34 and 34' are well sealed.

Numeral 40 indicates a leaf spring which is set between the side plates 34 and 34' and an inside wall of the rear case 37, and the pressing load of the leaf spring 40 is received by a protuberance 33*c* provided at the back of the seal block 33. Consequently, the leaf spring 40 presses the seal block supported by the side plates 34 and 34' in the direction of the arrow 401 (toward the inside face of the rear case 37) as shown in FIG. 4.

The side plates 34 and 34', and the gears 31 and 32, are positioned between the front cover 41 and the rear case 37 by the bearings 39*a* and 39*a'* provided for the driving gear 31, which are fitted in the side plates 34 and 34'. The driven gear 32 is supported by the bearings 39*b* and 39*b'*, and the shaft 202 for the driven gear 32 is set rotatably around the driving shaft 201 in a non-restricted state with respect to the front cover 41 and the rear case 37. Therefore, a reaction moment is generated to rotate all of the parts in the rear case 37 around the driving shaft 201. However, the rotation is prevented by the protuberance 33*c* of the seal block 33 which is pressed against and restrained by the inside surface of the rear case 37.

During pumping operations of the gears 31 and 32, since the pressure in the rear case 37 is higher than that at the suction port 35, and the seal block 33 is pressed to and supported against the side plates 34 and 34' by this pressure difference, and so the pressing load of the leaf spring 40 decreases relatively. The main role of the leaf spring 40 is to prevent the staggering of parts inside the rear case 37 in a low pressure state at the time the pump stops or starts.

Since the bearings 39*b* and 39*b'* provided for the driven gear 32 are set in a non-restricted rotary state, all the positions of the gears 31 and 32, the side plates 34 and 34' and the seal block 33, are determined, based on positional relations only with respect to the driving shaft 201. Therefore, the parallelism between the side plates 34 and 34' and the perpendicularity between the gears 31 and 32 and the side plates 34 and 34', which affects the operational performance of the pump 3, are not influenced by accumulation of working tolerances in the many parts. Therefore, it is easy to keep the parallelism and the perpendicularity accurate. If the bearings 39*b* and 39*b'* provided for the driven gear 32 are restrained by the front cover 41 and the rear case 37, since the parts in the gear pump 3 will be over-restrained, the parts will be influenced by the accumulation of working tolerances, and torsion may be generated in the shaft 201 and shaft 202.

As mentioned above, the gear pump 3 according to the present invention is what is called a movable plate seal block type gear pump, and in the seal block type gear pump 3, by sealing the sides of the gears 31 and 32 and a part of the teeth of the gears 31 and 32 with the side plates 34 and 34' and the seal block 33, fuel leakage inside the gear pump 3 is minimized. Although the role of the side plates 34 and 34' is to maintain a proper gap between the side plates 34 and 34' and the sides of the gears 31 and 32 constant, a macroscopic gap does not exist, since the side plates 34 and 34' actually contact the sides of the gears 31 and 32. When the pressure between the side plates becomes higher, the pressure of gasoline passing through gaps at the back sides of the side plates 34 and 34' also becomes higher. Consequently, the pressure equilibrium in the axial direction is maintained, and the side plates 34 and 34' are always in contact with the sides of the gears 31 and 32.

If the pressure equilibrium in the axial direction is destroyed and a gap is formed between the side plates 34 and 34' and the sides of the gear 31 and 32, gasoline will leak from a high pressure part to a low pressure part of the circumferential parts of the shafts 201 and 202 through the inside between the two side plates 34 and 34', causing deterioration of the pressure rising performance and the fuel consumption.

On the other hand, it is also desirable to avoid the possibility of the side plates 34 and 34' being too strongly pressed against the sides of the gears 31 and 32 from the point of view of increasing the load torque due to increased friction, wearing, heat seizure, etc., in the internal parts of the gear pump 3. Further, it is ideal when the side plates 34 and 34' slightly contact the sides of the gears 31 and 32 only in response to the pressing force generated by the pressure partition seals 38 and 38', which are made of an elastic material, such as rubber. Thus, it is possible to attain a very low fuel consumption.

The structural features of the seal block type gear pump 3 according to the present invention are summarized as follows.

(1) The tooth sealing angle a is set to an angle determined by the following equation: $\alpha=1.5\times360°/Z$, where Z is the number of teeth in the gear.

(2) Each of the pressure partition seals has the shape of a closed curve.

(3) A cross section of each pressure partition seal has the shape of steps.

At first, feature (1) will be explained. In the pressure distribution at a circumferential part of the gears 31 and 32 in the seal block type gear pump 3 shown in FIG. 3, a region in the surrounding circumferential part is a high pressure (discharge pressure) region, while a region from the gear engaging position (working place) to the suction port 35 is a low pressure region. Further, tooth sealing intervals 33*a* and 33*b* along which the side plates 34 and 34' contact the seal block 33 are transition regions from the low pressure to the high pressure. Moreover, in the transition regions, since the number of contacting teeth and the points of contact with the seal block 33 change corresponding to the rotation of the gears 31 and 32, the pressure distribution between the side plates 34 and 34' changes periodically. On the other hand, since the pressure distribution at the beck face of each side plate is determined by the arrangement position of a groove in which each pressure partition seal is located, and the pressure distribution is constant, it is difficult always to equalize the pressure at both sides of the side plates 34 and 34' in the shaft direction. Incidentally, each of the tooth sealing intervals 33*a* and 33*b* is an interval at which a part of the teeth in each gear and the seal block 33 contact each other while maintaining a very narrow gap, and the sides of the gears 31 and 32 are sealed to the position of the tooth crest height of each gear. Further, the tooth sealing intervals 33*a* and 33*b* only where the side plates 34 and 34' contact the seal block 33, have a smaller circular arch angle than that of each circular sealing portion in the seal block 33.

Figure 6:
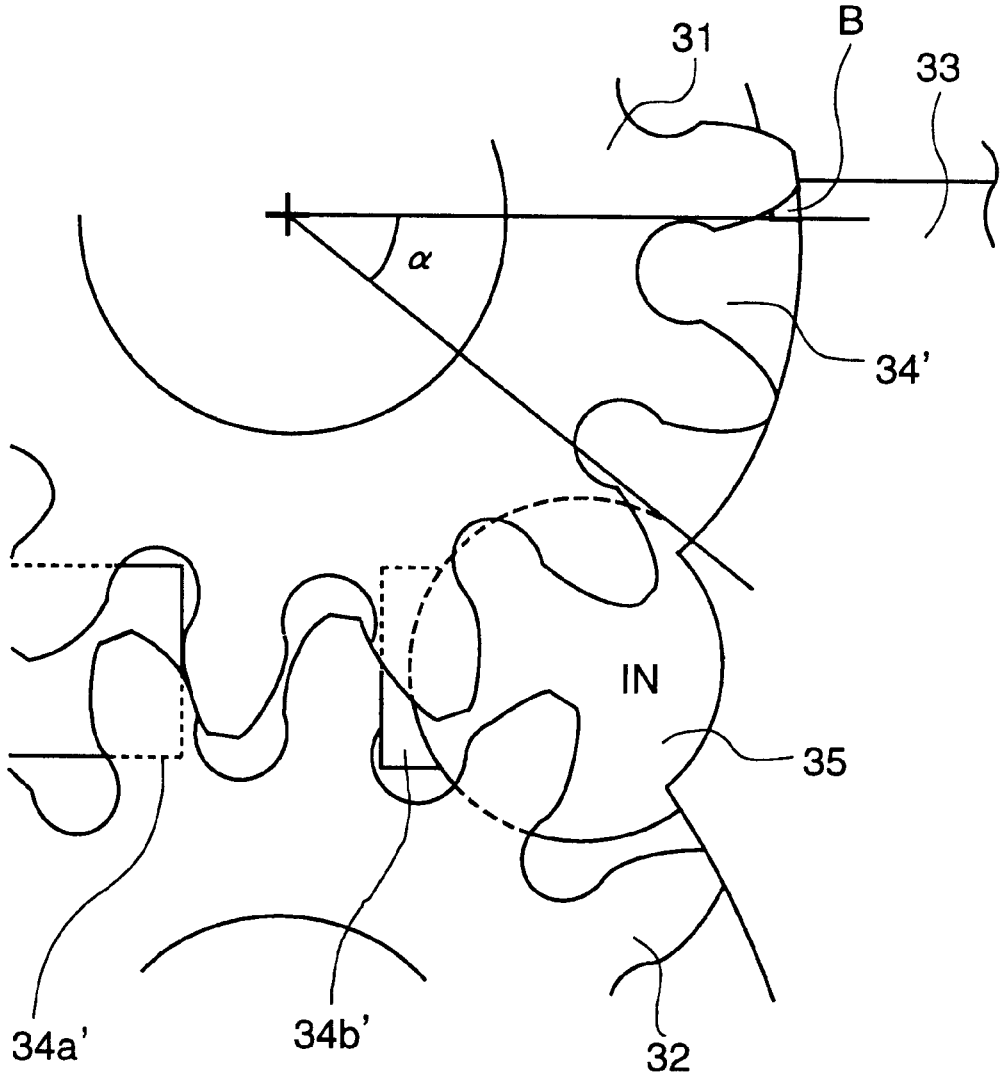
FIG. 6 is a diagrammatic view of a working area for two gears of the seal block type gear pump according to the present invention.

The tooth sealing portions are determined, based on an idea that the tooth sealing is performed with certainty by the seal block 33 for 1 to 2 teeth in each gear at a lower pressure side, and the other tooth portions of the gears 31 and 32 are positively exposed to the high pressure. Therefore, the amount the pressure changes is very much smaller than the integrated pressure value over the whole inside region of the side plates 34 and 34'. Further, it is necessary to minimize the amount the pressure changes in order to realize a more accurate pressure balance in the axial direction. Thus, the angle a for the tooth sealing portion shown in FIG. 6 is set to the following equation: $\alpha=1.5\times360°$/the number of teeth in the gear.

Figure 7A:
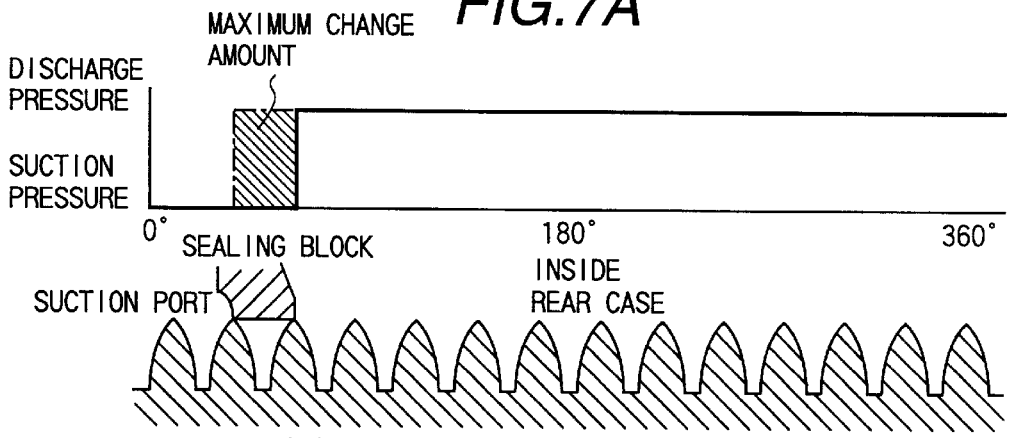
FIGS. 7A–7C are diagrams which show respective pressure distributions at circumferential parts of a gear in a seal block type gear pump for three different cases.
Figure 7B:
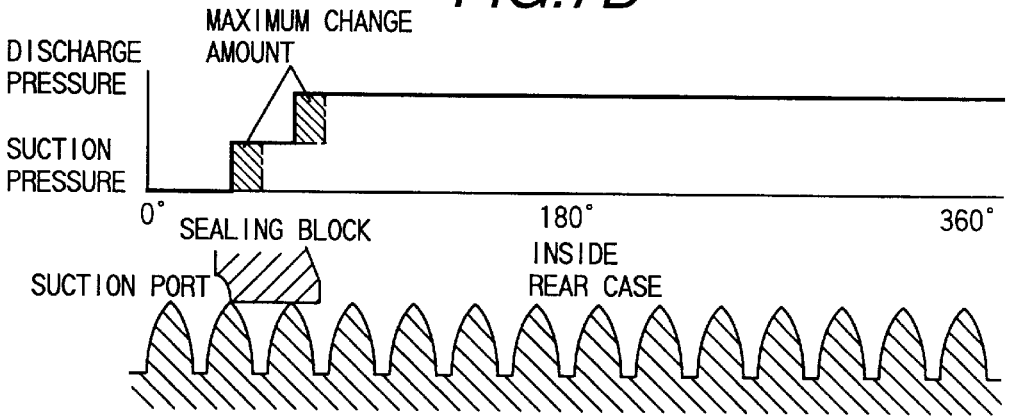
Figure 7C:
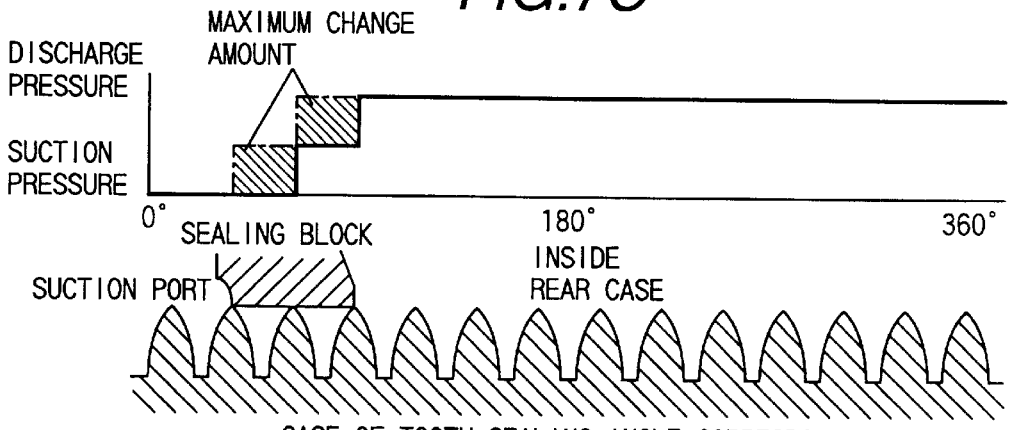

To seal up 1 to 2 teeth at the lower pressure side, the angle a for the tooth sealing portion is set to a value within a range of (1 to 2)×360°/the number of teeth in the gear, for example, the range of 25.7° to 51.4° for a gear having a total number 14 teeth. FIG. 7A to FIG. 7C illustrate respective pressure distributions along the circumference of a gear, which is imaginarily expanded to a linear line in these figures, for three cases of the sealing of 1 to 2 teeth, and the shadowed portion or portions in each of these figures indicate regions at which a maximum pressure change occurs. From these figures, it is seen that the pressure change is minimized in the ease of "$\alpha$=38.6°" for sealing 1.5 teeth.

For a gear having a whole number of 14 to 18 teeth, the angle a necessary for sealing 1.5 teeth is within a range of about 38.6° to 30.0°, and so the angle a may be set to a value of approximately 35°±5°.

Although the amount of pressure changes in the region between the side plates 34 and 34' can be minimized by the above-mentioned tooth sealing method, it is necessary to adjust the pressure distribution at the back side of each side plate accurately so as to coincide with the pressure distribution at the inside of the side plates 34 and 34' in order to realize a more precise pressure balance in the axial direction of the gear pump 3. Thus, in the seal block type gear pump 3 according to the present invention, as mentioned in the second feature: "(2) each of the pressure partition seals has a shape of a closed curve.", since the pressure is partitioned by one closed line seal located in a side face of each side plate, and the shape of the groove in which the seal is inserted can be freely set, the pressure distribution at the outside of each side plate can be precisely adjusted.

On the other hand, in a conventional seal block type gear pump, for example, the gear pump disclosed in Japanese patent publication 16300/1970, pressure partition sealing is realized by combining a plurality of O rings. Therefore, since interference among the O rings should be avoided, a pressure distribution at the back side of each side plate can not be flexibly and accurately adjusted. Moreover, difficulty in assembling the above-mentioned gear pump is one of the inherent problems which the above-mentioned conventional technique has. That is, since the side plates and a seal block are movable in the axial direction, O rings to be laid across one of the plates and the seal block tend to fall out from the side plates and the seal block during assembly.

In the seal block type gear pump 3 according to the present invention, by utilizing pressure partition sealing with a seal in the form of one closed curve, the pressure partition seals 38 and 38' hardly fallout from the side plates 34 and 34'. Consequently, the assembling of the pump is much easier.

As mentioned above, since the thrust in the axial direction can be almost completely balanced, it can be ensured that the gears 31 and 32 will contact the side plates 34 and 34' only slightly in response to a pressing force caused by elastic members, namely, the pressure partition seals 38 and 38', which are preferably made of rubber. The reason is that rubber exhibits a stable sealing performance in a wide temperature range from a low temperature to a high temperature, in which a vehicle engine is usually operated. Further, fluororubber is suitable for the seals 38 and 38' from the point of view of resistance to gasoline. However, using rubber causes swelling due to contact with the gasoline, and the swelling of the rubber seals 38 and 38' increases the clipping force (thrust) applied to the gears 31 and 32 by the side plates 34 and 34'.

As a counter measure to prevent the increase of the clipping force, the above-mentioned third feature (3) of the present invention is provided. That is, since the cross section of each pressure partition seal 38 has a stepped shape, which provides an expansion space to accommodate the swelling of each rubber seal, an increase of the clipping force applied to the gears 31 and 32 can be avoided. Further, since the spring constant of the seals 38 having a step-shaped cross section is lower than that of a conventional seal having a circular or square cross section, the seals 38 and 38' are not easily influenced by swelling of the rubber. Furthermore, even if the amount of collapse of the rubber seals 38 and 38' changes by the variation of accumulated working tolerances of the parts which make up the gear pump 3, the clipping force is hardly affected by these changes. Thus, an ideal state can be maintained, that is, the gears 31 and 32 always slightly contact the side plates 34 and 34' with an initial light clipping force.

Moreover, in the seal block type gear pump 3 according to the present invention, as shown in FIG. 6, the angle of the seal block 33 is set so that each circular arch at the two tooth sealing portions of the seal block 33 is larger than a circular arch at each tooth sealing portion in each of the side plates 34 and 34'. There are two reasons for providing such a configuration. One is to set the angle of the tooth sealing accurately, that is, by using this construction, the angle for the tooth sealing can be uniquely set by the angle of the circular arch at the tooth sealing portion without being affected by the variation of the angle of the circular arch at each tooth sealing portion of each of the side plates 34 and 34', which is due to a working accuracy change. The other is to prevent cavitation erosion, leading to improvement in the durability of the gear pump 3.

Although a seal block type gear pump according to the present invention has become applicable to a fuel system in a vehicle engine by using a booster pump to suppress the occurrence of cavitation in the fuel, nevertheless, gas bubbles possibly will be generated in the fuel in a high temperature engine state or at start up. If generated gas bubbles flow into the tooth spaces of the rotating gears 31 and 32 through the suction port 35, the gas bubbles existing in the tooth spaces will collapse just as the tooth spaces pass through each tooth sealing interval and enter the high pressure region, by rotation of the gears 31 and 32, since gasoline of high pressure flows into the tooth spaces. Thus, high pressure pulses may be generated.

By setting each circular arch at the two tooth sealing portions of the seal block 33 so that they are larger than the circular arch at the tooth sealing portion of each of the side plates 34 and 34', as shown in FIG. 6, a part Bin the tooth space begins to communicate with the high pressure region as it leads the whole tooth space, whereby the area of the part B increases continuously, and so the whole tooth space is finally opened to the high pressure region. Therefore, gasoline at high pressure flows into the tooth space from both sides of the gears 31 and 32 at the same time, and the gas bubbles in the tooth space are collapsed by the high pressure gasoline at the center in the face width direction. Thus, high pressure pulses act on the surfaces of the gears 31 and 32. However, since surface hardening processing is applied to the gears 31 and 32, cavitation erosion scarcely occurs at the surfaces of the gears 31 and 32, as opposed to the side plates 34 and 34' which are made of softer material. Thus, the durability and the life of the gear pump 3 can be improved.

In accordance with this embodiment of the present invention, it becomes possible to apply a seal block type gear pump, which has been used typically for an oil pressure system, to a pump for transferring fluid of low viscosity, such as gasoline. The effects of the embodiment are as follows.

(A) The occurrence of cavitation during fuel suction operations can be prevented.

(B) Fuel leakage inside the pump is reduced, which improves the volumetric efficiency of the pump.

(C) Friction among parts inside the pump is reduced, which improves the mechanical efficiency of the pump.

(D) A large increase in the life of a pump can be expected.

Further, on account of the above-mentioned effects of the present invention, it becomes possible also to apply a seal block type gear pump to a fuel system of a vehicle engine, and consequently, to provide a gear pump which has the highest efficiency in pumps of various types, for use in the fuel system of a vehicle engine, in which is required a high pressure rising performance and a low fuel consumption.

What is claimed is:

1. A fuel system for a vehicle engine in which fuel is injected and combusted by a spark ignition, said fuel system comprising:

a fuel injection nozzle for injecting fuel;

a gear pump including gears and a seal member for sealing up teeth of the gears engaging with each other in a sealed-up gear case, which seal member is provided at a place occupied by at most two teeth in the vicinity of a working area of said teeth in a low pressure side of the gear pump and is not connected to said gear case, said seal member having a low pressure fuel flowing hole for the flow of a low pressure fuel, wherein a tooth sealing angle for said at most two teeth is set substantially to a value within a range of 35°±5° for gears having 14 to 18 teeth, and a high pressure fuel flowing passage for the flow of a high pressure fuel, formed in a space other than said working area and the area of said sealing member, in said gear case;

a fuel tank;

a pipe connecting said fuel tank and said low pressure fuel flowing hole; and a pipe connecting said fuel injection nozzle and said high pressure fuel flowing passage.

2. A fuel system for a vehicle engine in which fuel is injected and combusted by a spark ignition, said fuel system comprising:

a fuel injection nozzle for injecting fuel;

a gear pump including gears and a seal member for sealing up teeth of the gears, engaging with each other in a sealed-up gear case, which seal member is provided at a place occupied by at most two teeth in the vicinity of a working area of said teeth in a low pressure side of the gear pump and is not connected to said gear case, said seal member having a low pressure fuel flowing hole for the flow of a low pressure fuel, and a high pressure fuel flowing passage for the flow of a high pressure fuel, formed in a space other than said working area and the area of said sealing member in said gear case, wherein the pressure in said high pressure fuel flowing passage is within a range of 3 to 10 MPa;

a fuel tank;

a pipe connecting said fuel tank and said low pressure fuel flowing hole; and a pipe connecting said fuel injection nozzle and said high pressure fuel flowing passage.

3. A fuel system for a vehicle engine in which fuel is injected and combusted by a spark ignition, said fuel system comprising:

a fuel injection nozzle for injecting fuel;

a gear pump including gears and a seal member for sealing up teeth of the gears engaging with each other in a sealed-up gear case, which seal member is provided at a place occupied by at most two teeth in a vicinity of a working area of said teeth in a low pressure side of the gear pump and is not connected to said gear case, said seal member having a low pressure fuel flowing hole for the flow of a low pressure fuel, wherein a tooth sealing angle for said at most two teeth is set substantially to a value within a range of 35°±5° for gears having 14 to 18 teeth, and a high pressure fuel flowing passage for the flow of a high pressure fuel, formed in a space other than said working area and the area of said sealing member, in said gear case, wherein the pressure in said high pressure fuel flowing passage is within a range of 3 to 10 MPa;

a fuel tank;

a pipe connecting said fuel tank and said low pressure fuel flowing hole; and a pipe connecting said fuel injection nozzle and said high pressure fuel flowing passage.

4. A fuel system for a vehicle engine in which fuel is injected and combusted by a spark ignition, said fuel system comprising:

a fuel injection nozzle for injecting fuel;

a gear pump including gears and a seal member for sealing up teeth of the gears engaging with each other in a sealed-up gear case, which seal member is provided at a place occupied by at most two teeth in the vicinity of a working area of said teeth in a low pressure side of the gear pump and is not connected to said gear case, said seal member having a low pressure fuel flowing hole for the flow of a low pressure fuel, and a high pressure fuel flowing passage for the flow of a high pressure fuel, formed in a space other than said working area and the area of said sealing member, in said gear cased a fuel tank;

a first pipe connecting said fuel tank and said low pressure fuel flowing hole;

a second pipe connecting said fuel injection nozzle and said high pressure fuel flowing passage; and a booster pump provided at an intermediate part of said first pipe, for raising the pressure of fuel transferred to said low pressure fuel flowing hole to a pressure value at which occurrence of cavitation at said low pressure fuel flowing hole can be suppressed.

5. A fuel system according to claim 4, wherein a discharge pressure of said booster pump is set to a value within a range of 0.2 to 0.5 MPa.

6. A gear pump for use in a fuel system in a vehicle, said gear pump comprising:

sears and a seal member for sealing up teeth of the gears engaging with each other in a sealed-up gear case, which seal member is provided at a place occupied by a plurality of teeth in the vicinity of a working area of said teeth in a low pressure side of the gear case and is not connected to said gear case, said seal member having a low pressure fuel flowing hole for the flow of a low pressure fuel; and a high pressure fuel flowing passage for the flow of a high pressure fuel, formed in a space other than said working area and the area of said sealing member, in said gear case; and side plates provided at both sides of said gears, wherein the heat expansion coefficient of material forming said gears is equal to that of material forming said side plates.

7. A gear pump for use in a fuel system in a vehicle, said gear pump comprising:

gears and a seal member for sealing up teeth of the gears engaging with each other in a sealed-up gear case, which seal member is provided at a place occupied by a plurality of teeth in the vicinity of a working area of said teeth in a low pressure side of the rear case and is not connected to said gear case, said seal member having a low pressure fuel flowing hole for the flow of a low pressure fuel, wherein a tooth sealing angle for said plurality of teeth is set substantially to an angle θ obtained by an equation expressed as "$\theta=1.5\times(360°/\text{the number } Z \text{ of teeth in a gear})$, where Z is in a range of 14 to 18"; and a high pressure fuel flowing passage for the flow of a high pressure fuel, formed in a space other than said working area and the area of said sealing member, in said gear case.

8. A gear pump comprising:

gears and a seal member for sealing up teeth of the gears engaging with each other in a sealed-up gear case, which seal member is provided at a place occupied by a plurality of teeth in the vicinity of a working area of said teeth in a low pressure side of the gear case and is not connected to said gear case, said seal member having a low pressure fuel flowing hole for the flow of a low pressure fuel, wherein a tooth sealing angle for said plurality of teeth is set substantially to a value within a range of 35°±5° for gears having 14 to 18 teeth; and a high pressure fuel flowing passage for the flow of a high pressure fuel, formed in a space other than said working area and the area of said sealing member, in said gear case.

9. A gear pump for use in a fluid system, said gear pump comprising:

gears and a seal member for sealing up teeth of the rears engaging with each other in a sealed-up gear case, which seal member is provided at a place occupied by a plurality of teeth in the vicinity of a working area of said teeth in a low pressure side of the rear case and is not connected to said gear case, said sealing member having a low pressure fuel flowing hole for the flow of a low pressure fuel;

a high pressure fuel flowing passage for the flow of a high pressure fuel, formed in a space other than said working area and the area of said sealing member, in said gear case; and a pressure partition seal in each of a pair of side plates provided at both sides of said gears, wherein each pressure partition seal has the shape of a closed curve.

10. A gear pump for use in a fluid system, said gear pump comprising:

gears and a seal member for sealing up teeth of the gears engaging with each other in a sealed-up gear case, which seal member is provided at a place occupied by a plurality of teeth in the vicinity of a working area of said teeth in a low pressure side of the gear case and is not connected to said gear case, said seal member having a low pressure fuel flowing hole for the flow of a low pressure fuel;

a high pressure fuel flowing passage for the flow of a high pressure fuel, formed in a space other than said working area and the area of said sealing member, in said gear case; and a pressure partition seal in each of a pair of side plates provided at both sides of said gears, wherein a cross section of said pressure partition seal is in the shape of steps.

11. A gear pump comprising:

gears and a seal member for sealing up teeth of the gears engaging with each other in a sealed-up gear case, which seal member is provided at a place occupied by a plurality of teeth in the vicinity of a working area of said teeth in a low pressure side of the gear case and is not connected to said gear case, said seal member having a low pressure fuel flowing hole for the flow of a low pressure fuel; and a high pressure fuel flowing passage for the flow of a high pressure fuel, formed in a space other than said working area and the area of said sealing member, in said gear case, wherein a shaft of a driven one of said gears is arranged so as to be not retrained by said gear case, and the internal arrangement of parts of said pump is such that a reaction forces due to rotation of said gears, applied to the internal parts as a whole, including said gears and said sealing member, is opposed at a middle position in a back face of said sealing member.

12. A gear pump comprising:

gears and a seal member for sealing up teeth of the gears engaging with each other in a sealed-up gear case, which seal member is provided at a place occupied by a plurality of teeth in the vicinity of a working area of said teeth in a low pressure side of the gear case and is not connected to said gear case, said seal member having a circular arch part and a low pressure fuel flowing hole for the flow of a low pressure fuel;

a high pressure fuel flowing passage for the flow of a high pressure fuel, formed in a space other than said working area and the area of said sealing member; and a pair of side plates provided at both sides of said gears, each having a sealing portion having a circular arch part, in said gear case, wherein the length of the circular arch part of said sealing member is larger than that of each circular arch part of the sealing portions of each side plate.

13. A fuel system for a direct injection type engine in which fuel is injected directly into a high pressure cylinder during a compression stroke and combusted by a spark ignition, said fuel system comprising:

a fuel injection nozzle for injecting fuel directly into the high pressure cylinder during a compression stroke;

a gear pump including gears and a seal member for sealing up teeth of the gears engaging with each other in a sealed-up gear case, which seal member is provided at a place occupied by at most two teeth in the vicinity of a working area of said teeth in a low pressure side of the gear pump and is not connected to said gear case, said seal member having a low pressure fuel flowing hole for the flow of a low pressure fuel, wherein a tooth sealing angle for said at most two teeth is set substantially to a value within a range of 35°±5° for gears having 14 to 18 teeth, and a high pressure fuel flowing passage for the flow of a high pressure fuel, formed in a space other than said working area and the area of said sealing member, in said gear case wherein the pressure in the high pressure fuel flowing passage is at least 3 Mpa;

a fuel tank;

a pipe connecting said fuel tank and said low pressure fuel flowing hole; and a pipe connecting said fuel injection nozzle and said high pressure fuel flowing passage.

14. A fuel system for a direct injection type engine in which fuel is injected directly into a high pressure cylinder during a compression stroke and combusted by a spark ignition, said fuel system comprising:

a fuel injection nozzle for injecting fuel directly into the high pressure cylinder during a compression stroke;

a gear pump including gears and a seal member for sealing up teeth of the gears engaging with each other in a sealed-up gear case, which seal member is provided at a place occupied by at most two teeth in the vicinity of a working area of said teeth in a low pressure side of the gear pump and is not connected to said gear case, said seal member having a low pressure fuel flowing hole for the flow of a low pressure fuel, and a high pressure fuel flowing passage for the flow of a high pressure fuel, formed in a space other than said working area and the area of said sealing member, in said gear cased a fuel tank;

a first pipe connecting said fuel tank and said low pressure fuel flowing hole;

a second pipe connecting said fuel injection nozzle and said high pressure fuel flowing passage; and means for raising the pressure of fuel transferred to said low pressure fuel flowing hole to a pressure value at which occurrence of cavitation at said low pressure fuel flowing hole can be suppressed.

15. A fuel system according to claim 14, wherein said means for raising pressure comprises a booster pump.

* * * * *